US011584997B2

(12) United States Patent
Myers et al.

(10) Patent No.: US 11,584,997 B2
(45) Date of Patent: Feb. 21, 2023

(54) METHOD OF COLORIZING STAINLESS STEEL USING STRIP ANNEAL PROCESSING

(71) Applicant: AK Steel Properties, Inc., West Chester, OH (US)

(72) Inventors: Frederick A. Myers, Middletown, OH (US); LeRoy R. Price, Reading, OH (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 780 days.

(21) Appl. No.: 16/513,313

(22) Filed: Jul. 16, 2019

(65) Prior Publication Data

US 2020/0024747 A1 Jan. 23, 2020

Related U.S. Application Data

(60) Provisional application No. 62/699,059, filed on Jul. 17, 2018.

(51) Int. Cl.

| | |
|---|---|
| ***C21D 9/56*** | (2006.01) |
| ***C23C 24/08*** | (2006.01) |
| ***C21D 7/06*** | (2006.01) |
| ***C21D 1/26*** | (2006.01) |
| ***C21D 8/02*** | (2006.01) |
| ***C21D 9/52*** | (2006.01) |
| ***C23C 18/12*** | (2006.01) |

(52) U.S. Cl.

CPC ..... *C23C 24/08* (2013.01); *C21D 1/26* (2013.01); *C21D 7/06* (2013.01); *C21D 8/0236* (2013.01); *C21D 8/0278* (2013.01); *C21D 9/52* (2013.01); *C21D 9/56* (2013.01); *C23C 18/1216* (2013.01)

(58) Field of Classification Search

CPC ..... C23C 24/08; C23C 18/1216; C21D 1/26; C21D 7/06; C21D 8/0236; C21D 8/0278; C21D 9/46

See application file for complete search history.

(56) References Cited

U.S. PATENT DOCUMENTS

2018/0127850 A1 5/2018 Myers et al.

OTHER PUBLICATIONS

Bonnet, G. et al., "The Effect of Rare Earths Deposited on Steel Surfaces, by Different Processes (SOL/GEL, Electrophoresis, OMCVD) on High Temperature Behaviour," Corrosion Science, vol. 35, Nos. 5-8, 1993, Great Britain, 7 pages.

International Search Report and Written Opinion dated Oct. 15, 2019 for Application No. PCT/US2019/042041, 10 pages.

*Primary Examiner* — Jessee R Roe

(74) *Attorney, Agent, or Firm* — Frost Brown Todd LLP

(57) ABSTRACT

A method of colorizing stainless steel strip involves the continuous surface treatment of stainless steel strip with aqueous suspensions of rare earth oxide nano or micro particles or aqueous rare earth nitrate solutions of nano or micro particles. The surface treatment can be applied by roll coating, spraying or other conventional application techniques. The coated strip is then continuously annealed. The surface treatment can provide a variety of colors. It also improves corrosion resistance of the processed stainless steel strip. Steel strip treated in this manner is suitable for a variety of applications in the building systems, automotive and appliance markets.

22 Claims, 4 Drawing Sheets

METHOD OF COLORIZING STAINLESS STEEL USING STRIP ANNEAL PROCESSING

PRIORITY

This application claims priority to U.S. Provisional Application Ser. No. 62/699,059 filed Jul. 17, 2018, entitled "Colorizing Stainless Steel Using Strip Anneal Processing;" the disclosure of which is incorporated by reference herein.

BACKGROUND

Surfaces of stainless steels can be modified using various techniques. For appearance-critical applications such as building panels, roofs or trim, stainless steel can be colorized using chemical treatments or paint. Stainless steel surfaces can be hardened by nitriding processes involving exposure to gasses, salt baths, or plasmas. Oxidation performance has been reported to be improved by alloying stainless steel with rare earth elements or by using ion implantation or sol-gel type coating techniques. All of these surface modification procedures are time consuming, involve the use of hazardous materials, and/or add substantial cost to the final material.

An alternative surface treatment and subsequent annealing process has been developed that imparts a durable colored non-metallic appearance to stainless steel alloys. This new process using thermal treatment, rather than the prior art chemical treatment to produce oxides on the surface of stainless steel and thereby impart color and corrosion resistance to the steel. Coils are processed using a standard continuous annealing cycle.

In some embodiments, the stainless steel material is first treated with a suspension containing up to 5% by weight nano- or micro-particles of a rare earth oxide, such as yttrium oxide. An aqueous nitrate rare earth solution can also be utilized. The oxide appears to impart various colors as well as superior corrosion resistance, each of which can be an important factor in exterior applications.

This new continuous annealing process is less expensive than alternative prior art stainless surface treatment processes because the colorizing processing can be accomplished using standard annealing equipment as part of the processing of steel strip, resulting in a relatively low cost per pound of final material. It also provides a "greener" alternative to conventional surface modification processing because chemical use is limited.

SUMMARY

The novel process involves the continuous surface treatment of stainless steel coils with aqueous suspensions of rare earth oxide nano or micro particles or aqueous rare earth nitrate solutions. The surface treatment can be applied by roll coating, spraying or other conventional application techniques. The coated strip is then heated using a continuous annealing process to develop a surface oxide that alters the surface appearance of stainless steel.

The surface treatment promotes a more uniform color to the subsequently developed oxide formed during anneal. It also improves corrosion resistance of the processed stainless steel material.

DETAILED DESCRIPTION

Figure 1:
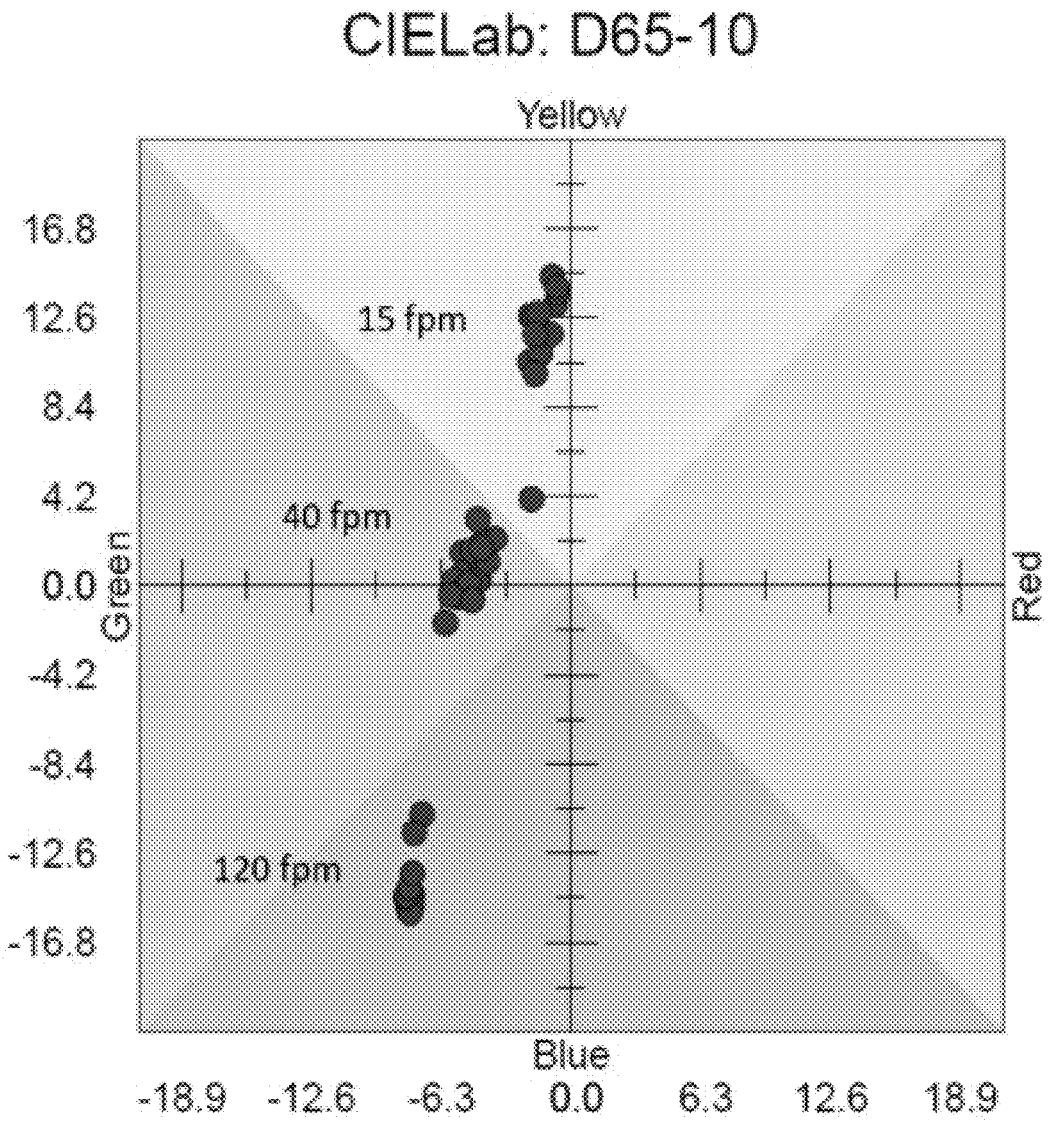
FIG. 1 depicts the color analysis per ASTM D2244 for Steel A of Example 3.

Colorized stainless steel can be produced by growing a surface oxide during heating of strip in a controlled atmosphere on a steel continuous annealing line. Growth of such thin film oxides, and the colors resulting from the various oxides and the various thickness of such oxides is well-known.

What is new is the use of a thermal process, such as that available in a typical continuous annealing furnace, to develop the oxide layers and thereby impart color to the stainless steel surface. In the present embodiments, colors can be varied by adjustments to line speed, temperature, atmosphere and substrate type.

This process also permits cold rolled stainless to be annealed (alteration of grain structure) concurrently with the colorizing step. This process is more economical than the typical chemical-based colorizing processes that involve treating individual panels/sheets. It also eliminates the need for the use of hazardous/environmentally unfriendly chemicals. Continuous strip processing can be more efficient than lengthy heat treatment of coils in a batch type box anneal process and provide better control over the critical variables.

Colorized stainless steel produced using this technique can be used for building panels, exhaust systems or other applications requiring an appearance different than the typical reflective metallic stainless steel. The processed material still retains the corrosion advantages of stainless steel when compared to traditional painted products with carbon steel substrates. Colors produced with this process are also less susceptible to color change due to the stability of the oxide created by the processing and the absence of organic bonds.

Coils of various grades of stainless steel strip including steels with austenitic or ferritic microstructures can be colorized by subjecting the strip to various combinations of heat and atmosphere using a continuous strip anneal line typically utilized to modify the steel microstructure and mechanical properties of the materials after cold rolling. These continuous process lines allow a uniform oxide to develop on the surface. The oxide can exhibit various colors depending on the annealing process parameters such as temperature, atmosphere, time, and dew point, as well as the chemistry of the stainless steel alloy and any pre-annealing coating applied to the strip.

In certain embodiments, to modify the oxide appearance and performance, one or more surfaces of the continuous strip may be given a rare earth-based coating treatment prior to the annealing step. Such rare earth treatments can be comprised of elements such as yttrium, cerium or lanthanum.

Both fully annealed, as well as cold rolled (non-annealed), stainless steel can be colorized using this process. While any stainless steel can be colorized using the present process, to also obtain improved corrosion resistance, it is preferred to use low carbon stainless steels, including austenitic and ferritic stainless steels, containing no more than 0.03 wt %/o carbon.

The stainless steel surface can be colorized by developing an oxide on various substrates prior to annealing such as cold-rolled, 2D, 2B, #4 polished, shot blast, or embossed finishes (e.g., AK Steel Corp.'s GREYSTONE® MATTE finish). For the unannealed material, annealing and colorizing can occur simultaneously.

In many embodiments, the steel strip is pretreated with a rare earth element such as yttrium in order to maximize corrosion/weathering performance. A surface treatment of stainless steel strip with aqueous suspensions of rare earth oxides or aqueous rare earth nitrate solutions, such as those containing yttrium, lanthanum, cerium, or zirconium provides a unique surface finish that provides both functional and aesthetic benefits. In some embodiments, the aqueous suspensions contain microparticles of rare earth oxides; in other embodiments, the aqueous suspensions contain nanoparticles of rare earth oxides. "Nanoparticles" are defined as particles with dimensions from 0.1-100 nm and "microparticles" are defined as particles with dimensions from 0.1-100 μm. "Rare earth" materials include those containing yttrium, lanthanum, cerium, or zirconium. One such suspension is Minimox® yttria nanoparticle suspension, available from Materials Interface, Inc. of Sussex, Wis.

The surface treatment can be applied to a coil of stainless steel by roll coating, spraying or other conventional application techniques. Subsequent drying in the range of 70-300° F. (21-149° C.) is only needed to remove the water component of the suspension or solution. Thus, the drying leaves a residue of the rare earth compound in the range of 300 to 3000 $\mu g/m^2$, or in some embodiments 500-1000 $\mu g/m^2$. The surface treatment promotes a more uniform color to the subsequently developed oxide formed during annealing. When a nitrate-containing starting material is used as the surface treatment, it is changed to an oxide during the anneal process. In addition to imparting color to the steel surface, the surface treatment, and resulting oxide coating on the stainless steel, also improves corrosion resistance of the steel.

The coated strip is annealed using a continuous annealing process. Annealing times and temperatures can vary, depending on the desired finished color. Surface finishes such as #4 Polish or other finish known in the art may be imparted to the strip prior to OCA.

The annealing temperatures and atmospheres can vary depending on the use of reducing or oxidizing gases in the annealing furnace. In certain embodiments, an atmosphere of about 20-30% by weight hydrogen and about 70-80% by weight nitrogen blend of gases is used. In other embodiments 100% nitrogen, 100% hydrogen or 100% air is used. Other reactive gases such as dissociated ammonium or inert gases such as argon can be used by themselves or can be mixed into the hydrogen and/or nitrogen atmospheres. The atmospheres can be "dry" (with a dew point of approximately 0° F. (−17° C.) or less, or in some embodiments with a dew point of approximately −40° F. (−40° C.) or less) or "wet" (with a dew point of +60° F. (15° C.) or more, or in some embodiments with a dew point +80° F. (26.7° C.) or 100° F. (37° C.) or more). Dry atmospheres tend to develop duller, darker surfaces than wet atmospheres. Annealing times can vary from 60 seconds to 1 hour, in other embodiments the annealing time can range between 4-20 minutes, in still other embodiments the annealing time can range between 5-10 minutes, and in still other embodiments the annealing time can range between 2-4 minutes. Temperatures can vary from 1000° F. (537.7° C.) to 2200° F. (1204° C.) depending on the capability of the annealing equipment, and in other embodiments the temperature can range between 1500° F. (815° C.) and 1900° F. (1038° C.). Annealing temperature, as well as time, can affect the resulting color of the finished surface treatment.

Stainless steel is generally defined as a steel containing about 10.5% by weight chromium or more. Any ferritic or austenitic stainless steel can be used in the present process. The grade of stainless steel of a particular embodiment (such as Types 436, 409, or 439 stainless steel, or CHROMESHIELD® 22 stainless steel (UNS S44330), which is available commercially from AK Steel Corporation, West Chester, Ohio) influences the colors developed under the same annealing conditions. The finish on the surface of the stainless steel (for example, 2B—temper rolled Ra<20 μin; 2D—no temper roll Ra<60 μin; #4 Polish—directional scratch pattern Ra<45 μin; ESD—shot blasted surface Ra 60-100 μin; or GREYSTONE® finish—roll textured finish Ra 100-200 μin available from AK Steel Corporation, where Ra is the commonly used arithmetic average roughness of a surface (defined in ASME B46.1)) also affects color and gloss of the finished processed material. Less reflective incoming substrates produce typically correspondingly less reflective finishes after continuous annealing.

The present processes alter the metallic appearance of stainless steel. Thus, by selecting the grade of stainless steel, its surface finish, and the annealing time and atmosphere, a person of skill in the art using the teachings of the present application can create a surface finish on stainless steel with the desired functional and aesthetic properties. A variety of color and textures can be obtained to provide a stainless steel-based product that is suitable for use as building panels, roofing, automotive exhaust or appliances.

Example 1

Two 436L fully annealed stainless steel coils portions of which were surface treated with yttrium nanoparticles were heated on a strip anneal/pickle line. The downstream acid pickling portion of the line was by-passed. The coils were heated in an oxidizing atmosphere for 3-4 minutes at 1950° F./1065° C. The resulting surfaces appeared dark/black with no evidence of the typically "shiny" stainless surface. Differences in appearance were detected between the yttrium oxide treated and non-treated portions.

Although the color was altered, subsequent testing indicated that the corrosion resistance of the material was negatively affected. This is likely due to the effects of the oxidizing atmosphere or inadequate yttrium oxide coverage.

Example 2

A trial was conducted on a strip decarburization/anneal line using a fully annealed CHROMESHIELD® 22 stainless steel coil that was coated on one side with yttrium nanoparticles. The same surface had previously been given a GREYSTONE MATTE texture. The strip was unwound and passed through various furnace zones from 1500° F. to 1870° F. with corresponding dew points of 70° F. and 25° F. and hydrogen/nitrogen ratios of 25/75 and 35/65, respectively. Depending on the line speed (time during heating was 4 to 16 minutes) the surface appeared dark blue at 80 fpm, lighter blue at 40 fpm, and yellow/gold at 5-10 fpm. Corrosion results on samples removed from the strip indicated performance was satisfactory for use as an outdoor building panel material.

Example 3

Various fully annealed stainless steel grades were coated and then run through a decarburization/annealing furnace.

Figure 2:
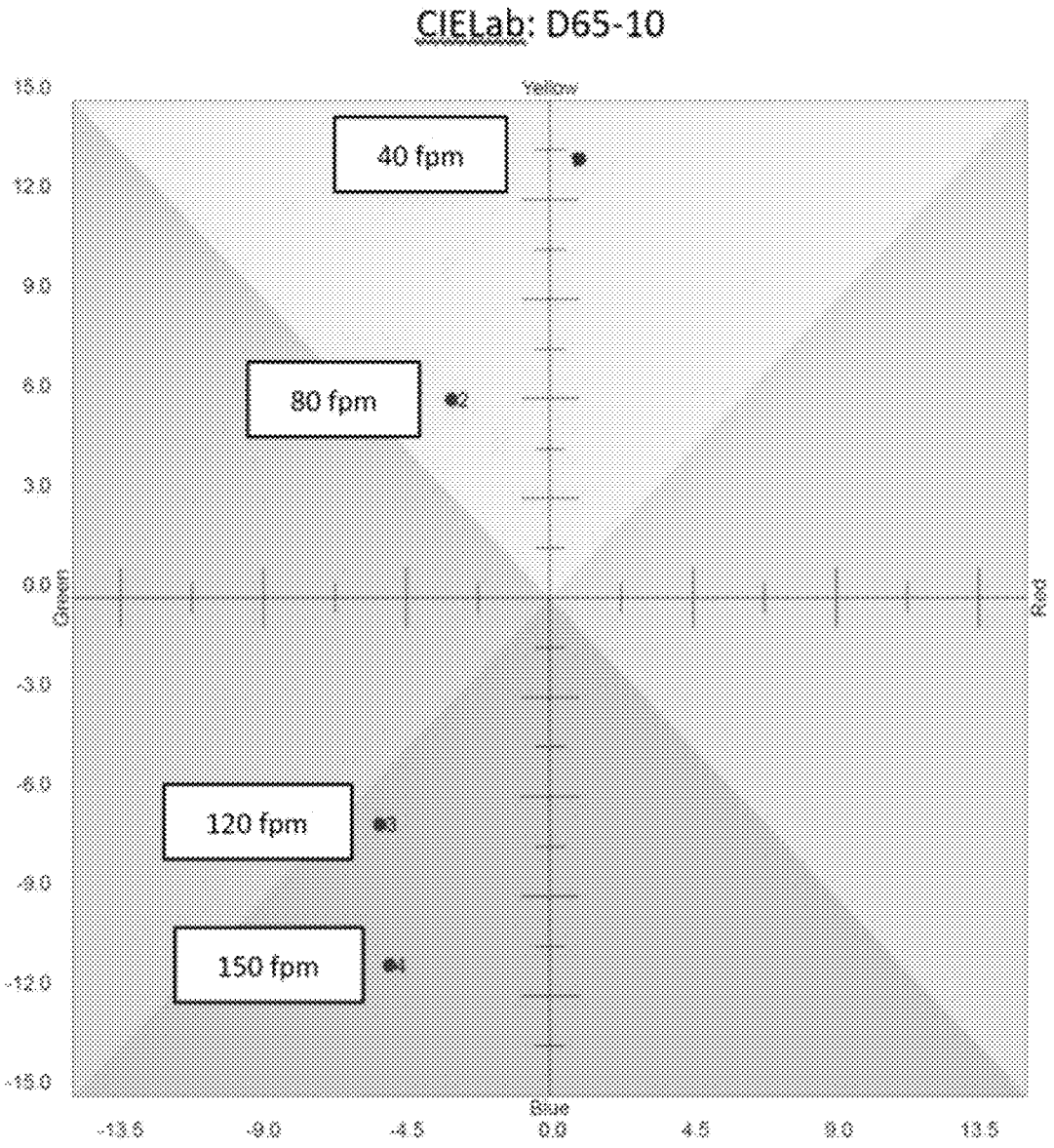
FIG. 2 depicts the color analysis per ASTM D2244 for Steel B of Example 3.
Figure 3:
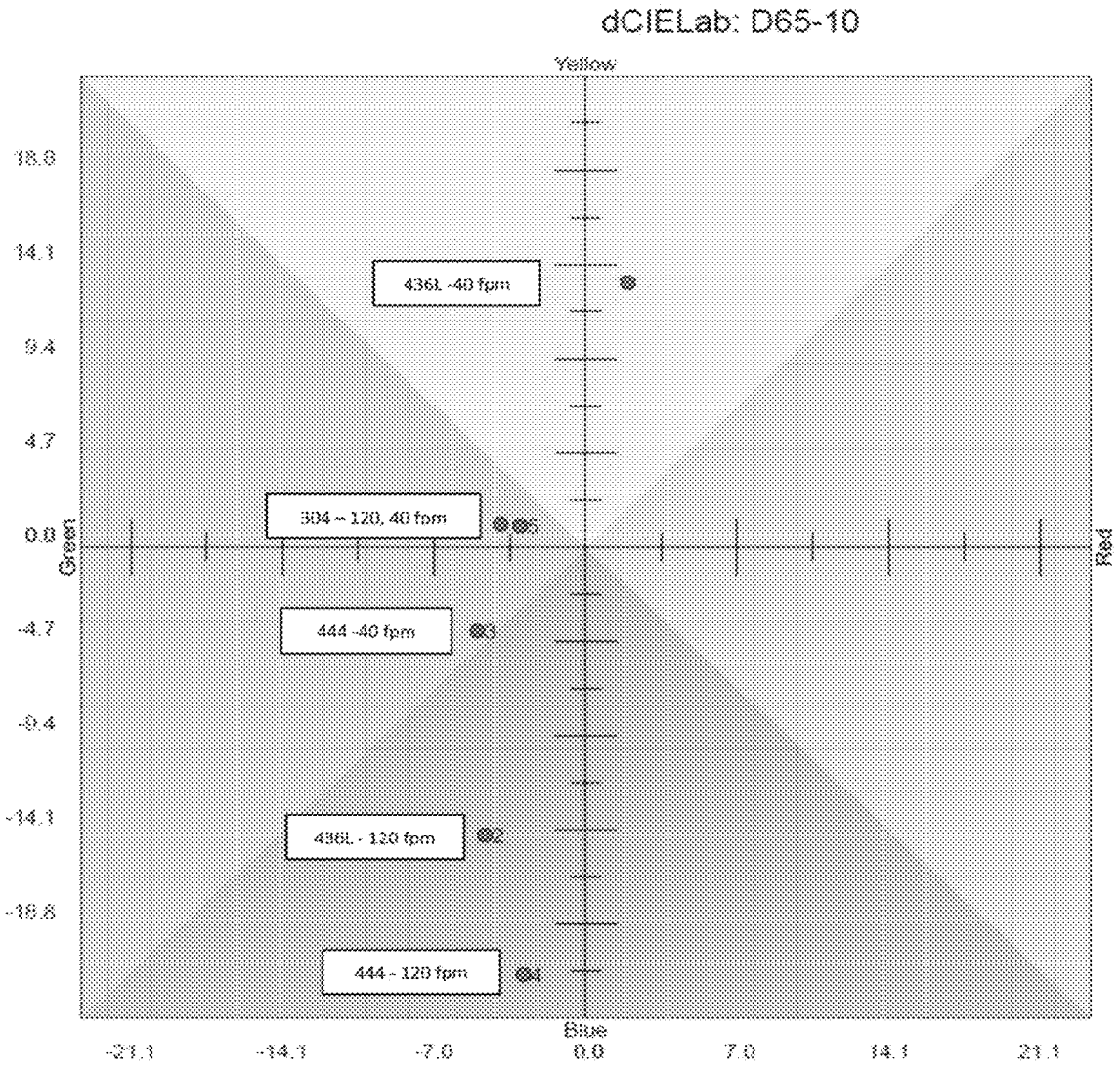
FIG. 3 depicts the color analysis per ASTM D2244 for Steels C-E of Example 3.

The material was coated on one or both side with yttrium oxide nanoparticles prior to entry into the furnace. Depending on the material and time in the furnace (as determined by line speed through the furnace), different color coatings were obtained. The conditions and results of those runs are set forth below in Table 1. Color analysis of the finished product, pursuant to ASTM D2244 for trials A-E, are set forth in FIG. 1-3, respectively.

Example 4

Figure 4:
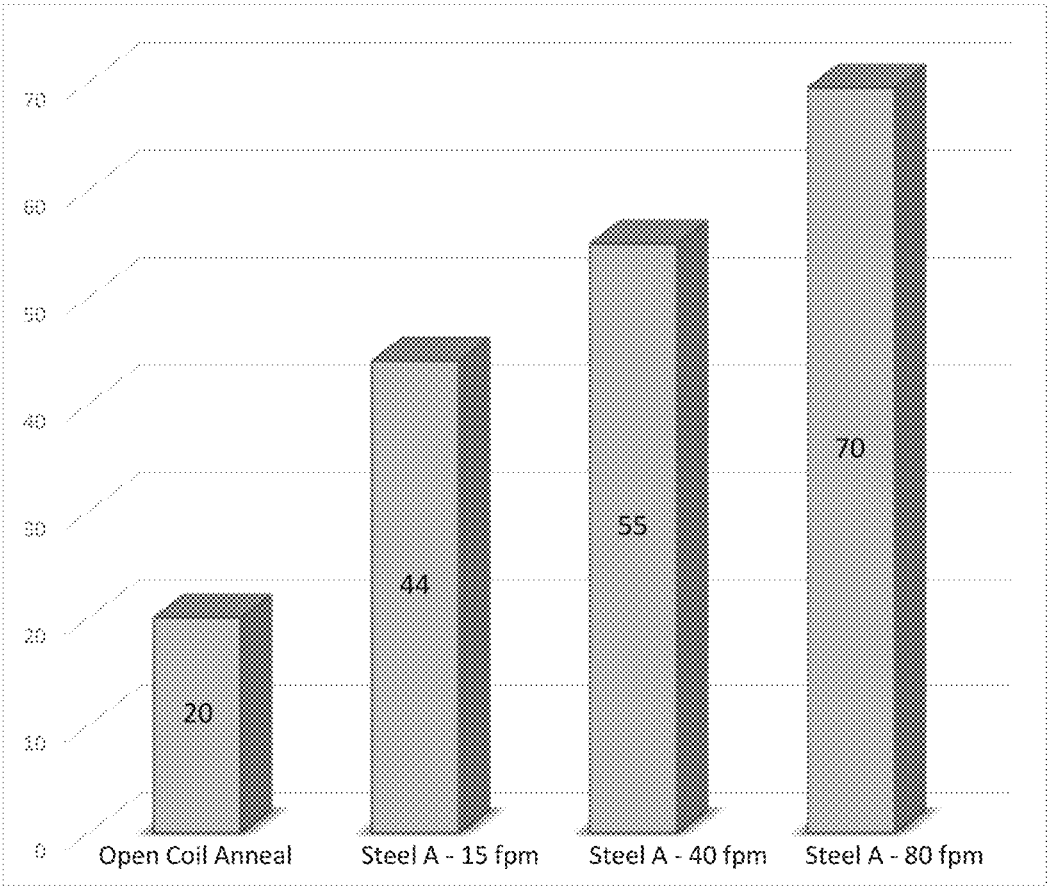
FIG. 4 depicts the gloss evaluation of an open coil anneal vs. continuous strip annealing reported in gloss units, in accordance with ASTM D523.

A comparison of the gloss achieved on coated/continuously annealed steels of Example 3 with the gloss achieved on steel coated/open coil annealed in accordance with the method of U.S. patent application Ser. No. 15/788,387, entitled "Surface Modification of Stainless Steels," filed on Oct. 19, 2017, which is incorporated herein by reference, shows that the steels of the present invention exhibit a higher gloss. See FIG. 4 which shows the average 60-degree gloss evaluation (ASTM D523) for a 436 grade steel processed in an open coil anneal process, and Steel A of Example 3 above run at 15 fpm, 40 fpm, and 80 fpm through the continuous annealing furnace. The steels of Example 3 exhibit more gloss than a similarly coated/open-coil annealed product.

Example 5

A process for colorizing the surface of stainless steel strip comprises:

coating said stainless steel strip on at least one of the said sides with at least one of an aqueous suspension comprising a rare earth oxide or an aqueous solution comprising a rare earth nitrate;

continuously annealing said coated stainless steel strip.

Example 6

The process of Example 5 or any one or more of the subsequent examples, wherein the rare earth oxide comprises nanoparticles.

Example 7

The process of any one or more of Examples 5 or 6, or any one or more of the subsequent examples, wherein the rare earth oxide comprises microparticles.

Example 8

The process of any one or more of Examples 5-7, or any one or more of the subsequent examples 12-23, wherein the continuous anneal process is performed in a dry atmosphere with a dewpoint of less than about 0° F.

Example 9

The process of any one or more of Examples 5-8, or any one or more of the subsequent examples 12-23, wherein the dewpoint is less than about −40° F.

Example 10

The process of any one or more of Examples 5-7, or any one or more of the subsequent examples 12-23, wherein the continuous anneal process is performed in a wet atmosphere with a dewpoint of more than 80° F.

Example 11

The process of any one or more of Examples 5-7, or 10, or any one or more of the subsequent examples 12-23, wherein the continuous anneal process is performed in a wet atmosphere with a dewpoint of more than 100° F.

Example 12

The process of any one or more of Examples 5-11, or any one or more of the subsequent examples, wherein the coating leaves a residue of a rare earth oxide in the range of about 300 to about 3000 $\mu g/m^2$.

Example 13

The process of any one or more of Examples 5-12, or any one or more of the subsequent examples, wherein the residue of the rare earth oxide is in the range of 500 to about 1000 $\mu g/m^2$.

Example 14

The process of any one or more of Examples 5-13, or any one or more of the subsequent examples, wherein the continuous anneal process is performed at a temperature between 1000° F. and 2200° F.

Example 15

The process of any one or more of Examples 5-14, or any one or more of the subsequent examples, wherein the continuous anneal process is performed at a temperature between 1500° F. and 1870° F.

Example 16

The process of any one or more of Examples 5-15, or any one or more of the subsequent examples 20-23, wherein the annealing atmosphere comprises approximately 100% by weight hydrogen.

Example 17

The process of any one or more of Examples 5-15, or any one or more of the subsequent examples 20-23, wherein the annealing atmosphere comprises approximately 100% by weight nitrogen.

Example 18

The process of any one or more of Examples 5-15, or any one or more of the subsequent examples 20-23, wherein the annealing atmosphere comprises approximately 20-30% by weight hydrogen, and the balance nitrogen.

Example 19

The process of any one or more of Examples 5-15, or any one or more of the subsequent examples 20-23, wherein the annealing atmosphere comprises ambient air.

Example 20

The process of any one or more of Examples 5-19, or any one or more of the subsequent examples, wherein the stainless steel strip resides in the annealing furnace for a time of 60 seconds to 1 hour.

Example 21

The process of any one or more of Examples 5-20, or any one or more of the subsequent examples, wherein the stainless steel resides in the annealing furnace for a time of 4 minutes to 20 minutes.

Example 22

The process of any one or more of Examples 5-21, or any one or more of the subsequent examples, wherein the stainless steel resides in the annealing furnace for a time of 5 minutes to 10 minutes.

Example 23

The process of any one or more of Examples 5-22, or any one or more of the subsequent examples, wherein the stainless steel resides in the annealing furnace for a time of 2 minutes to 4 minutes.

Example 24

The process of any one or more of Examples 5-23, or any one of the subsequent examples, wherein, prior to subjecting the stainless strip to a continuous annealing process, at least one side of said stainless steel strip is treated so as to impart to said side a surface finish selected from the group consisting of 2B, 2D, #4 Polish, shot blast, and embossed finishes.

Example 25

The process of any one or more of Examples 5-24, wherein prior to the coating and continuous annealing steps, the steel strip is cold-rolled.

Example 26

The process of any one or more of Examples 5-24, wherein prior to the coating continuous annealing steps, the steel strip is continuously annealed.

TABLE 1

| ID | Melt Grade | Temper Roll Ra 200 microinches | Yttrium Oxide | Gauge (inches) | Width (inches) | Results |
|---|---|---|---|---|---|---|
| A | 447-10 (CHROMESHIELD ® 22) | GREYSTONE ® One Side Only | Top side only | 0.0240 | 48.15 | Anneal at 15 fpm (yellow color), 40 (light blue color) and 80 fpm (darker blue color). |
| B | 436-14 | GREYSTONE ® One Side Only | Both sides | 0.021 | 41.5 | Anneal, 150 fpm, Dark Blue. 120 fpm, Light Blue/green, 80 fpm, Blue/Green. 40 fpm, Gold Colored strip |
| C | 304-42 | GREYSTONE ® One Side Only | Both sides | 0.0303 | 48.53 | Anneal - 40 fpm (olive green color) and at 120 fpm (lighter olive green color) |
| D | 444SS | GREYSTONE ® One Side Only | Both sides | 0.0197 | 33 | Anneal - 40 fpm (light Blue color) and at 120 fpm (dark purple color) |
| E | 436-14 | GREYSTONE ® One Side Only | Both sides | 0.021 | 41.5 | Anneal - 40 fpm (Gold Color) and at 120 fpm (Blue Color) |

TABLE 1-continued

| ID | Front of Furnace, 225 ft long | Back end of Furnace, 110 ft long | Time in Hot Section of Furnance | Corrosion (ASTM B117 Salt Fog) |
|---|---|---|---|---|
| A | 35% hydrogen/balance nitrogen, +68 F. dew point, furnace temperature 1,500 F. | 46% hydrogen/balance nitrogen, +25 F. dew point, furnace temperature 1,870 F. | 15 fpm = 22.35 min, 40 ft/min = 8.38 minutes, 80 ft/min = 4.19 minutes | Jun. 12, 2018 - corrosion samples submitted. Good after 500 hours, both faces |
| B | 35% hydrogen/balance nitrogen, +68 F. dew point, furnace temperature 1,500 F. | 46% hydrogen/balance nitrogen, +25 F. dew point, furnace temperature 1,870 F. | 40 ft/min = 8.38 minutes, 80 ft/min = 4.19 minutes. 120 ft/min = 2.79 minutes, 150 ft/min = 2.32 minutes | None or Minor blushing after 24 Hrs; Isolated minor spots after 500 Hrs |
| C | 35% hydrogen/balance nitrogen, +68 F. dew point, furnace temperature 1,500 F. | 46% hydrogen/balance nitrogen, +25 F. dew point, furnace temperature 1,870 F. | 40 ft/min = 8.38 minutes, 120 ft/min = 2.79 minutes | Poor Corrosion due to high carbon grade of 304 |
| D | 35% hydrogen/balance nitrogen, +68 F. dew point, furnace temperature 1,500 F. | 46% hydrogen/balance nitrogen, +25 F. dew point, furnace temperature 1,870 F. | 40 ft/min = 8.38 minutes, 120 ft/min = 2.79 minutes | 40 fpm - No corroison after 240 hrs; 120 fpm. - Light streaks after 240 hrs |
| E | 35% hydrogen/balance nitrogen, +68 F. dew point, furnace temperature 1,500 F. | 46% hydrogen/balance nitrogen, +25 F. dew point, furnace temperature 1,870 F. | 40 ft/min = 8.38 minutes, 120 ft/min = 2.79 minutes | 40 fpm - Light streaks after 240 hrs; 120 fpm - light streaks after 240 hrs |

What is claimed is:

1. A process for colorizing the surface of stainless steel strip comprising:

coating said stainless steel strip on at least one of the sides with at least one of an aqueous suspension comprising a rare earth oxide or an aqueous solution comprising a rare earth nitrate; continuously annealing said coated stainless steel strip, wherein the stainless steel resides in the annealing furnace for a time of 2 minutes to 20 minutes.

2. The process of claim 1, wherein the rare earth oxide comprises nanoparticles.

3. The process of claim 1, wherein the rare earth oxide comprises microparticles.

4. The process of claim 1, wherein the continuous anneal process is performed in a dry atmosphere with a dewpoint of less than about 0° F.

5. The process of claim 4, wherein the dewpoint is less than about −40° F.

6. The process of claim 1, wherein the continuous anneal process is performed in a wet atmosphere with a dewpoint of more than 80° F.

7. The process of claim 6, wherein the continuous anneal process is performed in a wet atmosphere with a dewpoint of more than 100° F.

8. The process of claim 1, wherein the coating leaves a residue of a rare earth oxide in the range of about 300 to about 3000 $\mu g/m^2$.

9. The process of claim 8, wherein the residue of the rare earth oxide is in the range of 500 to about 1000 $\mu g/m^2$.

10. The process of claim 1, wherein the continuous anneal process is performed at a temperature between 1000° F. and 2200° F.

11. The process of claim 10, wherein the continuous anneal process is performed at a temperature between 1500° F. and 1870° F.

12. The process of claim 1 wherein the annealing atmosphere comprises approximately 100% by weight hydrogen.

13. The process of claim 1, wherein the annealing atmosphere comprises approximately 100% by weight nitrogen.

14. The process of claim 1, wherein the annealing atmosphere comprises approximately 20-30% by weight hydrogen, and the balance nitrogen.

15. The process of claim 1, wherein the annealing atmosphere comprises ambient air.

16. The process of claim 1, wherein the stainless steel resides in the annealing furnace for a time of 4 minutes to 20 minutes.

17. The process of claim 1, wherein the stainless steel resides in the annealing furnace for a time of 5 minutes to 10 minutes.

18. The process of claim 1, wherein the stainless steel resides in the annealing furnace for a time of 2 minutes to 4 minutes.

19. The process of claim 1, wherein, prior to subjecting the stainless strip to a continuous annealing process, at least one side of said stainless steel strip is treated so as to impart to said side a surface finish selected from the group consisting of 2B, 2D, #4 Polish, shot blast, and embossed finishes.

20. The process of claim 1, wherein the steel strip is cold-rolled before the coating and continuous annealing steps.

21. A process for colorizing the surface of stainless steel strip comprising:

coating said stainless steel strip on at least one of the sides with at least one of an aqueous suspension comprising a rare earth oxide or an aqueous solution comprising a rare earth nitrate; continuously annealing said coated stainless steel strip; and cold rolling the steel strip before the coating and continuous annealing steps.

22. A process for colorizing the surface of stainless steel strip comprising:

Coating said stainless steel strip on at least one of the sides with at least one of an aqueous suspension comprising a rare earth oxide or an aqueous solution comprising a rare earth nitrate; continuously annealing said coated stainless steel strip; and continuously annealing the steel strip before the coating and continuous annealing steps.

* * * * *